United States Patent [19]

Brüggemann

[11] Patent Number: 4,705,404

[45] Date of Patent: Nov. 10, 1987

[54] METHOD AND APPARATUS FOR PROCESSING MIXED ASPHALT MATERIAL UTILIZING BROKEN-UP USED ASPHALT

[75] Inventor: Horst Brüggemann, Glashütten, Fed. Rep. of Germany

[73] Assignee: Deutsche Asphalt GmbH, Frankfurt, Fed. Rep. of Germany

[21] Appl. No.: 887,092

[22] PCT Filed: Oct. 31, 1985

[86] PCT No.: PCT/DE85/00433

§ 371 Date: Jul. 11, 1986

§ 102(e) Date: Jul. 11, 1986

[87] PCT Pub. No.: WO86/02962

PCT Pub. Date: May 22, 1986

[30] Foreign Application Priority Data

Nov. 13, 1984 [DE] Fed. Rep. of Germany ..... 3441382

[51] Int. Cl.[4] ..... B28C 5/08; B28C 5/46

[52] U.S. Cl. ..... 366/7; 366/14; 366/25; 432/111

[58] Field of Search ..... 366/4, 7, 14, 25; 432/105, 106, 111; 106/281 R; 404/80

[56] References Cited

U.S. PATENT DOCUMENTS 4,189,238 2/1980 Mendenhall ..... 366/7
4,387,996 6/1983 Mendenhall ..... 366/4
4,626,198 12/1986 Cohen ..... 432/106 X

FOREIGN PATENT DOCUMENTS 0114118 7/1984 European Pat. Off. .

*Primary Examiner*—Philip R. Coe
*Attorney, Agent, or Firm*—Spencer & Frank

[57] ABSTRACT

A method as well as an apparatus for processing asphalt mixtures is provided in which broken-up used asphalt is employed and new material is added, utilizing a plurality of burner-heated drum devices, with the used asphalt component and the new material for the asphalt mixture to be processed or produced being processed, i.e. heated in particular, in respectively differently configured drum devices. The used asphalt component is heated separately in a drum mixer operated with parallel flow and the new material component is heated in a drying drum operated with counterflow. After leaving their respective drum devices, the components are conducted into at least one further connected mixer and are further treated there with fresh bitumen and possibly with filler material being added in the mixer. Furthermore, the exhaust gases of the drum mixer are introduced directly into the drying drum and are further heated there, thus combusting the $CH_x$ and CO component contained therein.

In this process, the exhaust gases of the drum mixer are introduced into the interior of the drying drum in the immediate vicinity of the burner flame through flow channels in the form of nozzles via a feed device formed at the frontal face of the drying drum in which the burner is disposed, with the direction of the nozzles being adjustable as a function of the size of the burner flame.

24 Claims, 3 Drawing Figures

METHOD AND APPARATUS FOR PROCESSING MIXED ASPHALT MATERIAL UTILIZING BROKEN-UP USED ASPHALT

BACKGROUND OF THE INVENTION

1. Field of the Invention

The invention relates to a method for processing remixed asphalt materials and to an apparatus for implementing the method.

2. Description for the Background

In known methods for reprocessing used asphalt, a distinction must be made as to whether the processing systems operate with a drying drum operated with counterflow or a drum mixer operated with parallel flow. Drying drums operated with counterflow exhibit better efficiency than the parallel-flow methods with respect to the exchange of heat between the flame and the material to be heated. On the other hand, difficulties arise in the counter flow methods with respect to processing the broken-up used asphalt material.

During this process, hydrocarbons ($CH_x$) escape from the bitumen in the asphalt, and slight, smoldering combustion produces considerable amounts of carbon monixide (CO). This gas, in spite of an extensive use of filtering devices, escapes into the outside air together with the exhaust gas and produces a considerable pollution of the environment. The legally prescribed minimum emission quantities are generally far exceeded.

SUMMARY OF THE INVENTION

It is an object of the invention to provide a method and an apparatus for implementing a method of the above-mentioned type which overcome the above-mentioned drawbacks and assure, in particular, that the manufacturing and reprocessing process can regulate with precision the mixing ratio of used and new components of the material to be processed and the heat balance and the period of dwelling of the material within the system.

DESCRIPTION OF THE INVENTION

This is accomplished in a process of the above-mentioned type by processing, i.e., heating in particular, separately in differently configured drum devices, the portions of used asphalt and new material for the asphalt mixture to be processed or produced wherein the used asphalt component is heated in a drum mixer operated with parallel flow and the new material component to separately heated in a drying drum operated with counterflow. After leaving the respective drum devices, these materials are conducted into at least one further connected mixer where they are further treated with fresh bitumen and filler material possibly being added to the mixer. The exhaust gases of the drum mixer are conducted directly into the drying drum and are there heated further so that the $CH_x$ and CO components contained therein are combusted.

The method according to the invention assures primarily a processing of mixed asphalt favorable to the environment reuses broken-up asphalt. More particularly the used asphalt component which is sensitive to extreme heat is heated to the at least initially maximum possible temperature independently of the new material component in a separate drum device, During this heating process of the used asphalt, the relatively low temperatures of the heating gases cause carbon monoxide (CO) to be released. The CO gas after being transferred to the drum mixer is further heated together with the heating gases developed there and is converted to carbon dioxide ($CO_2$), and only after this conversion is the gas released to the environment.

Moreover, the above-described process does not require any special conveying or throwing devices within the two drum devices. Rather, generally known conveying devices and conventional drum devices can be employed.

According to the invention, the exhaust gases of the drum mixer are conducted into the interior of the drying drum in the immediate vicinity of the burner flame, via an intake device formed at the frontal face of the drying drum where the burner is disposed.

This type of introduction of the exhaust gases into the interior of the drying drum assures that intimate contact is established with the burner flame, and thus, that the incompletely combusted exhaust gases from the drum mixer are combusted further.

In a further feature according to the invention, the exhaust gases of the drum mixer are positively guided to the burner flame or directly past this flame, depending on the respective size or expanse of the burner flame. The burner flame is adjusted, in accordance to the amount of heat required, i.e., its expanse may be different with respect to its length as well as its expanse (diameter). It is therefore significant that the direction of the exiting exhaust gas streams are oriented toward the burner flame in a manner corresponding to the respective size of the flame.

Advantageously, the exhaust gases of the drum mixer are conducted around the burner flame in the form of an at least partially enveloping stream.

In a further feature of the invention, the used asphalt component is heated in the drum mixer preferably to about 170° C. and the new material component is heated to about 180° to 350° C. These values constitute approximate limit values which assure heating of the respective materials in a manner nondeleterious to the environment and economical with respect to the thermal balance.

Advantageously, the mixing ratio between the used asphalt component and the new material component is adjustably regulatable in the asphalt mixture, with preferably the used asphalt component being considerably in the majority.

The above-described temperature and mixing ratio settings assure that the intimate mixing of the two components of the asphalt mixture in the mixer connected to the two drum devices is performed in an optimum manner, i.e., that the used asphalt component in particular is decomposed further.

Advantageously, the asphalt mixture, composed of a used asphalt component and a new material component in a defined mixing ratio is further heated in the connected mixer and held at the desired final temperature. This additional heating assures that the decomposition process of the used asphalt component is not interfered with or destroyed.

Preferably, after passing through the first mixer, the asphalt mixture is processed further in a second, connected mixer, thus obtaining even more intensive bonding of the material components.

It is a further object of the invention to provide an apparatus for implementing the above-mentioned method, with such apparatus permitting the use, in particular, of conventional components, particularly drum devices, mixers, etc.

This further object of the invention is accomplished in that two parallel operating drum devices are provided for separately processing, i.e. heating in particular, the used asphalt component and the new material. The drum device intended for processing the used asphalt component is a drum mixer operating with parallel flow and the drum device intended for processing the new material is a drying drum operating with counterflow. The material discharge locations in the two drum devices are connected with at least one subsequent mixer. The drum mixer and the drying drum are connected together via an exhaust gas conduit ending in the form of a feed channel at the frontal face of the drying drum where the burner is disposed. The feed channel is connected, via apertures, with the interior of the drying drum.

This configuration of the device permits a precise setting of the temperatures in the two separate drum devices for treating the two different asphalt mixture components in a manner suitable for the material involved. It also permits a precise setting of the mixing ratio before the materials are fed into the connected mixer as well as complete combustion of the in completely combusted exhaust gases from the drum mixer.

As a feature of the invention, the apertures are provided in the form of flow channels, particularly nozzles. This type of opening assures a uniformly guided exhaust gas stream.

Advantageously, the flow channels are arranged so as to concentrically surround the burner opening and they are adjustable with respect to their direction of flow and with respect to the direction of the burner flame. In this way, the flow of exhaust gases can always be conducted, corresponding to the respective diameter of the burner flame, at the optimum distance from the burner flame.

Advantageously, all existing flow channels are coupled together and controlled in synchronism. The nozzles are here adjustable in conjunction with the burner flame. This configuration of the flow channels permits a controlled regulation of the introduction of the exhaust gases and thus optimum combustion of the gases.

Advantageously, the first mixer is connected to a second mixer which is configured to correspond to the first mixer and both are dual-shaft, positive-flow and flow-through mixers. This assures a particularly intensive mixing of the components of the asphalt mixture.

Advantageously, the mixers are heatable, thus permitting precise setting of the temperature of the asphalt mixture, particularly with respect to the desired final temperature. The mixers further contain feed devices for fresh bitumen and filler material. This makes it possible to supplement the two asphalt mixture components coming out of the preceding drum devices with respect to their material composition so as to produce the required final composition of the asphalt mixture.

An embodiment, which does not limit the invention, is illustrated in the drawings and will be described below.

DESCRIPTION OF THE PREFERRED EMBODIMENTS

Figure 1:
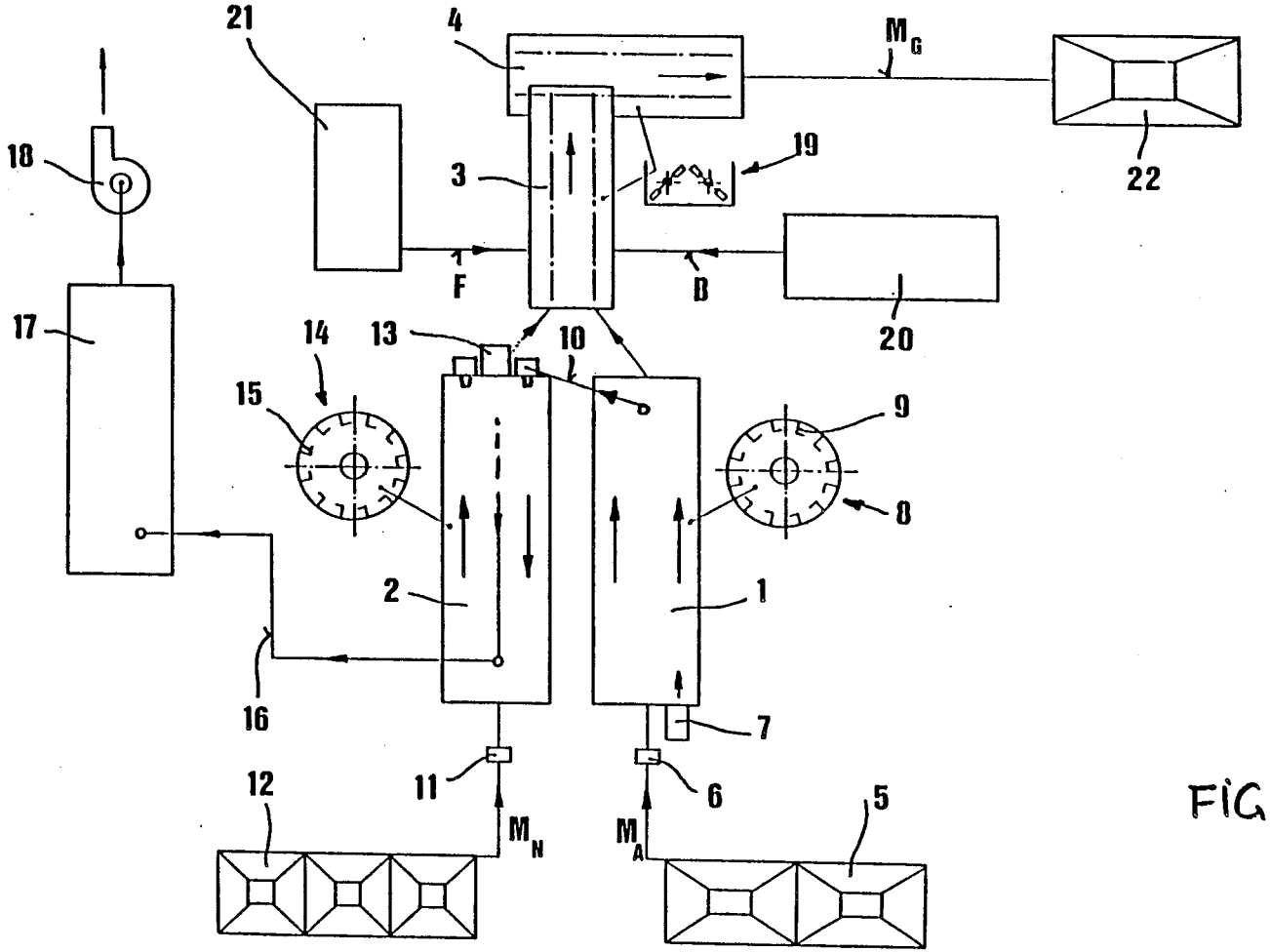
FIG. 1, is a system sketch of a complete processing system.
Figure 2:
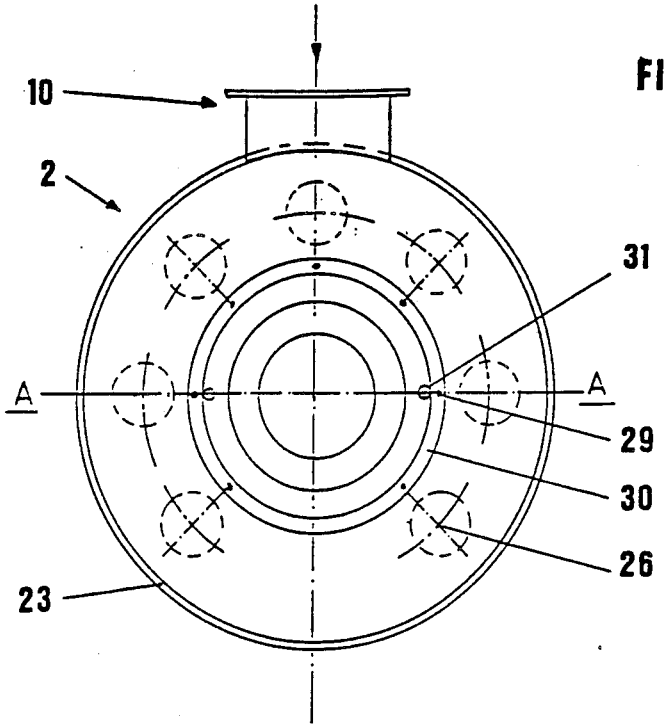
FIG. 2, is an external view of the frontal face of drying drum 2 in which the burner is disposed.
Figure 3:
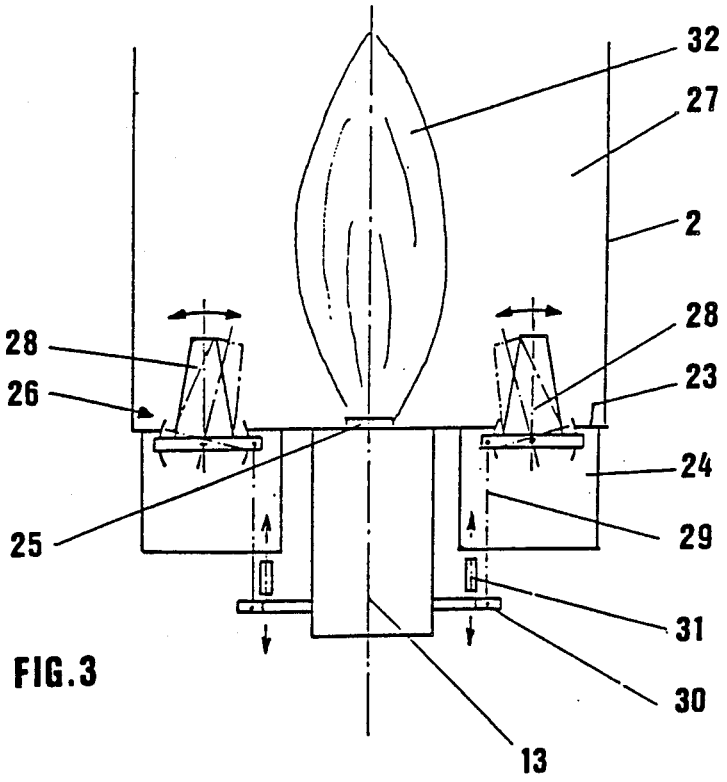
FIG. 3, is a partial sectional view along line A—A of FIG. 2 through drying drum 2.

The device proposed for the implementation of the method according to the invention is essentially composed of a drum mixer 1 operated with parallel flow, a drying drum 2 operated with counterflow and two mixers 3 and 4 associated with a drum mixer 1 and a drying drum 2.

The asphalt mixtuer $M_G$ to be processed is primarily composed of a used asphalt component $M_A$ and a new material component $M_N$ to which was added bitumen B and filler material F.

The used asphalt component $M_A$ is removed from a storage device 5 via a conveying scale 6 and introduced into the drum mixer 1, thus passing through the interior of the drum mixer which is heated by burner 7. The interior of the drum mixer 1 is equipped with conventional conveying devices 9 indicated by their cross sections 8.

At its end opposite burner 7, drum mixer 1 is equipped with an exhaust gas conduit 10, which is indicated schematically and is connected via this conduit to the drying drum 2. The special configuration of exhaust conduit 10 at the frontal face of drying drum 2 where burner 13 is disposed is described below.

In the drying drum 2, the new material component $M_N$ to be processed therein is introduced via a conveying scale 11 from a supply device 12 at the frontal face opposite burner 13 and is transported through the mixer and heated by conveying devices 15 shown schematically in cross section 14.

At its end facing burner 13, the drying drum 2 is provided with an exhaust gas conduit 16 which is connected with a filter dust removal system 17. From this filter dust removal system, the exhaust gases are discharged to the environment by means of a ventilating device 18.

The asphalt mixture components $M_A$ and $M_N$ are heated in the drum mixer 1 and the drying drum 2, and then received by a first mixer 3 which is designed as a dual shaft positive-flow and flow-through mixer as shown schematically in section at 19. Additionally, the mixer 3 is heatable, for example, in the form of a dual-wall trough in which a heating medium is able to flow through the space between the walls.

The mixer 3 again receives certain percentages of fresh bitumen obtained from a bitumen supply vessel 20 and filler material F obtained from a filler supply vessel 21, which are mixed together.

Mixer 3 is connected to a second mixer 4 of corresponding construction.

Finally, the completely processed asphalt mixture $M_G$ is removed from the second mixer 4 and held ready in a shipping device 22.

Exhaust gas conduit 10 coming from drum mixer 1 ends directly at the frontal face 23 of the drum mixer 2 and is configured as a feed channel 24 which surrounds burner 13 and which is connected with the interior of the drying drum 2 via apertures 26 that are arranged concentrically around burner opening 25. Flow channels 28 in the form of nozzles are inserted into the apertures and are able to introduce the stream of exhaust gases exiting therefrom into the interior 27 of the drying drum 2 in freely selectable directions. These pivotal nozzles 28 are controlled via pull rods 29 and a setting ring 30 as well as setting cylinders 31 with all nozzles 28 being connected together via this setting system and being controllable in synchronism while being coupled together. The angular position of the nozzles 28 can be set as a function of the size and expanse of burner flame 32.

The above-described configuration of apertures 26 in the frontal face 23 of the drying drum 2 makes it possible to guide the respective stream of the individual nozzles in such a manner that depending on the expanse of burner flame 32 the exhaust gas to be flown in is not blown directly into the burner flame 32, but is brought past the burner flame at a certain distance therefrom. In this way, the fuel material of the burner is always combusted completely within the burner flame 10 and at the same time the introduced exhaust gas is combusted optimally.

What is claimed is:

1. In a method for processing mixed asphalt material utilizing broken-up used asphalt and new material utilizing a plurality of burner-heated drums, comprising heating used asphalt in a parallel-flow drum mixer under conditions substantially avoiding damage to the used asphalt, and heating the new material to a temperature higher than the temperature of the asphalt in a counter-flow drying drum, mixing the used asphalt and the new material in a connected mixer while adding bitumen and filler to obtain an asphalt mixture, the improvement comprising introducing exhaust gases comprising $CH_x$ and CO from the parallel-flow drum mixer directly into the drying drum;

heating the gases to a temperature sufficient to allow the combustion or decomposition of $CH_x$ and CO in the drying drum; and allowing for the heating gases to further heat the new material in the drying drum to a temperature higher than that of the used asphalt.

2. The method of claim 1 wherein the gases in the drying drum are heated with a flame.

3. The method of claim 2, wherein the exhaust gases exiting from the parallel-flow drum are fed into the interior of the drying drum in the immediate vicinity of the flame.

4. The method of claim 3, where the exhaust gases exiting from the parallel-flow drum are conducted directly into the flame.

5. The method of claim 3, wherein the exhaust gases exiting from the parallel-flow drum are passed directly by the flame.

6. The method of claim 3, wherein the exhaust gases exiting from the parallel-flow drum are conducted around the flame in the form of at least a partial jacket stream.

7. The method of claim 1, wherein the used asphalt is heating in the parallel-flow drum up to about 170° C.; and the new material is heated in the drying drum to a temperature between about 180° C. and 350° C.

8. The method of claim 1, wherein the mixing ratio of the used asphalt to the new material is adjustabley regulatable.

9. The method of claim 1 wherein the amount of used asphalt component is in a considerable majority of the asphalt mixture.

10. The method of claim 1, further comprising heating the asphalt mixture in the connected mixer to maintain a desired temperature.

11. The method of claim 1, wherein the ratio of bitumen and filler added into the mixer is adjustaby regulatable.

12. The method of claim 1, further comprising mixing the asphalt mixture exiting from the connected mixer in a further mixer in communication with said connected mixer.

13. In an apparatus for processing asphalt material utilizing broken-up used asphalt and adding new material, comprising first and second parallel drum devices, wherein said first device is a parallel-flow mixer for processing the used asphalt, and said second device is a counter-current drying drum for processing the new material; said first and second devices having material discharge points and said second device having a frontal face provided with apertures and a burner;

at least one mixer;

means for transferring exhaust gas containing $CH_x$ and CO connected said first and said second devices;

means connecting the material discharge points of said first and second devices with said at least one mixer; the improvement wherein said means for transferring is connected to said first device at the material discharge point and ends in the form of a feed channel in the frontal face of the second device, said channel being connected through the apertures to the inside of the second device.

14. The apparatus of claim 13, wherein the at least one mixer is a heatable mixer.

15. The apparatus of claim 13, wherein the apertures of the second devices are flow channels.

16. The apparatus of claim 15, wherein the flow channels are nozzles.

17. The apparatus of claim 15, wherein the flow channels concentrically surround the aperture of the burner.

18. The apparatus of claim 15, wherein the direction of flow of the channels can be varied as a function of the direction of a flame in the burner.

19. The apparatus of claim 18, wherein all flow channels are coupled with one another.

20. The apparatus of claim 19, wherein all flow channels are controlled in synchronism.

21. The apparatus of claim 20, wherein the flow channels can be adjusted as a function of flame size.

22. The apparatus of claim 13, further comprising one other mixer connected to said at least one mixer, said one mixer and said one other mixer being double-shaft positive-flow flow-through mixers.

23. The apparatus of claim 22, wherein the one other mixer is a heatable mixer.

24. The apparatus of claim 22, further comprising means for feeding bitumen and filler to said one mixer and said one other mixer.

* * * * *